US010898911B2

(12) United States Patent
Santagiuliana

(10) Patent No.: US 10,898,911 B2
(45) Date of Patent: Jan. 26, 2021

(54) DEVICE FOR DISPENSING A MIXTURE, PREFERABLY A FOAM, AND SYSTEM USING SAID DEVICE

(71) Applicant: TAPLAST s.r.l., Dueville (VI)-Fraz. Povolaro (IT)

(72) Inventor: Evans Santagiuliana, Vicenza (IT)

(73) Assignee: TAPLAST S.R.L.

( * ) Notice: Subject to any disclaimer, the term of this patent is extended or adjusted under 35 U.S.C. 154(b) by 309 days.

(21) Appl. No.: 16/063,033

(22) PCT Filed: Dec. 5, 2016

(86) PCT No.: PCT/IB2016/057347
§ 371 (c)(1),
(2) Date: Jun. 15, 2018

(87) PCT Pub. No.: WO2017/103726
PCT Pub. Date: Jun. 22, 2017

(65) Prior Publication Data

US 2020/0238312 A1 Jul. 30, 2020

(30) Foreign Application Priority Data

Dec. 15, 2015 (IT) ..... 102015000083272

(51) Int. Cl.
*B05B 11/04* (2006.01)
*B05B 7/00* (2006.01)
(Continued)

(52) U.S. Cl.
CPC ..... *B05B 7/0037* (2013.01); *B05B 11/3087* (2013.01); *A47K 5/14* (2013.01);
(Continued)

(58) Field of Classification Search
CPC ... B05B 11/0059; B05B 11/043; B05B 11/04; B05B 7/0037; B05B 7/0025; B65D 88/28; B65D 88/022; B65D 90/205
(Continued)

(56) References Cited

U.S. PATENT DOCUMENTS 4,836,422 A 6/1989 Rosenberg
5,310,093 A * 5/1994 Bennett ..... B05B 7/0018 222/190

(Continued)

FOREIGN PATENT DOCUMENTS

DE 9110905 1/1993
WO WO2014016427 1/2014
WO WO2015097606 7/2015

OTHER PUBLICATIONS

International Searching Authority European Patent Office, International Search Report and Written Opinion for PCT/IB2018/058443 dated Jan. 25, 2019.

*Primary Examiner* — Charles Cheyney
(74) *Attorney, Agent, or Firm* — McDonald Hopkins LLC

(57) ABSTRACT

The invention concerns a device (10) for dispensing a mixture (S) constituted by a first fluid (F1) and a second fluid (F2), suited to be applied to a container (C). The device comprises: an outlet duct (20) for the mixture (S); a reception and/or transit chamber (43); means (50, 60) for generating the mixture (S); first valve means comprising a first movable element (32); second valve means comprising a second movable element (32); third valve means comprising a third movable element (31*a*, 31*b*). Two among the first movable element (32), the second movable element (32) and the third movable element (31*a*, 31*b*) belong to a single valve element (30; 130). The invention concerns also a system for dispensing a mixture (S) constituted by a first
(Continued)

fluid (F1) and a second fluid (F2) comprising a container (C) and a device (10) as described above.

11 Claims, 10 Drawing Sheets

(51) Int. Cl.
*B05B 11/00* (2006.01)
*A47K 5/14* (2006.01)

(52) U.S. Cl.
CPC ..... *B05B 11/0059* (2013.01); *B05B 11/043* (2013.01); *B05B 11/047* (2013.01)

(58) Field of Classification Search
USPC ..... 222/190, 207, 209
See application file for complete search history.

(56) References Cited

U.S. PATENT DOCUMENTS

| | | | | |
|---|---|---|---|---|
| 6,394,315 | B1 * | 5/2002 | Banks | B05B 7/0037 222/190 |
| 8,360,282 | B2 | 1/2013 | van der Heijden | |
| 9,718,070 | B2 * | 8/2017 | Arminak | A47K 5/14 |
| 2002/0153389 | A1 * | 10/2002 | Creaghan | B05B 11/043 222/190 |
| 2002/0179735 | A1 | 12/2002 | Santagiuliana | |
| 2005/0098581 | A1 | 5/2005 | Long | |
| 2009/0001100 | A1 * | 1/2009 | van der Heijden | A47K 5/122 222/190 |
| 2015/0078117 | A1 | 3/2015 | Santagiuliana | |
| 2015/0224454 | A1 * | 8/2015 | Albertz | A47K 5/14 261/59 |

* cited by examiner

DEVICE FOR DISPENSING A MIXTURE, PREFERABLY A FOAM, AND SYSTEM USING SAID DEVICE

CROSS-REFERENCE TO RELATED APPLICATIONS

This is the U.S. national phase of international application no. PCT/IB2016/057347 filed on Dec. 5, 2016, which claims priority based on Italian patent application no. 102015000083272 filed on Dec. 15, 2015.

TECHNICAL FIELD OF THE INVENTION

The present invention concerns the technical field of systems for dispensing mixed fluids.

In particular, the present invention concerns the production of a device suited to dispense mixtures constituted by two fluids and to be applied to a deformable container, preferably suited to be pressed manually and containing said two fluids, in particular for dispensing a mixture in the form of foam.

The invention furthermore concerns the development of a system for dispensing mixtures, comprising a container and a dispensing device applied to said container.

DESCRIPTION OF THE STATE OF THE ART

It is known that in the field of the systems for dispensing products in the form of foam dispensing devices are used which are applied to deformable containers, typically made of plastic, which when manually pressed allow the foam to be dispensed through said devices with the container positioned upside down, that is, with the outlet duct of the device facing downwards.

In these dispensing systems the foam is generated by properly mixing a given quantity of liquid and air collected from said containers.

The fields of use of these types of systems for dispensing fluids and producing foams are the most varied. In the sector of cleaning products, foams used to clean bathrooms, glass panes, ovens, pieces of furniture, as well as soaps, shampoos or face cleansing products are produced. With regard to personal hygiene and health, the products in the form of foam are, for example, hand, hair, skin care products, shaving foams or even animal care products, for example cat and dog cleaning products. There are also applications in the medical sector, for example sun protection products to be applied to the skin or other products.

The systems of the known type consist of a dispensing device applied to the neck of a container. In the dispensing device it is possible to identify a chamber into which the liquid and the air drawn by a drawing tube located in the container are conveyed during the manual deformation of the container itself.

The mixture of liquid and air conveyed into this chamber flows out of the latter and is transformed into foam owing to the presence of a filtering element provided with suitable microholes that, also depending on the viscosity characteristics of the liquid and on the quantity of air mixed with said liquid, allow the mixture to be let out in the form of foam.

The dispensing devices applied to the containers are substantially made up of a supporting structure provided with means for coupling them with the neck of the container and with a fluid suction unit suited to suck the fluids from the inside of the container and to produce the foam that will be successively dispensed.

The foam generated in this way is dispensed towards the external environment through a suitable outlet duct.

The suction unit is thus provided with first and second valve means suited to allow and/or interrupt the passage of the liquid and the air, respectively, from the inside of the container towards the outside.

Following the dispensing of a dose of foam, corresponding quantities of liquid and air suited to make up the mixture are drawn from the container.

At the end of the dispensing operation, when the deformed/pressed container is released and returns to its normal not deformed/squeezed shape, the container itself is refilled with a given quantity of air, in order to prevent it from remaining partially squeezed.

For this purpose, the dispensing device is furthermore provided with an air refilling system, which is equipped with further respective valve means and makes it possible to suck a suitable quantity of air from the outside when the container returns to its normal shape in the configuration in which it is not squeezed.

The dispensing devices belonging to the state of the art, however, pose some drawbacks.

A first drawback of said dispensing devices is constituted by the fact that they are difficult to manufacture, in particular due to the presence of different valve means for controlling the flow of the fluids during the dispensing of foam and for refilling the container with air during the corresponding step.

Another drawback of the dispensing devices of the known type is represented by the fact that it is difficult to assemble the various components that make them up.

A further drawback of the dispensing devices of the known type is represented by their production cost, due to the number of elements and/or to the time it takes to assemble them.

It is the object of the present invention to overcome at least part of the drawbacks described above.

It is a first object of the invention to provide a dispensing device for the generation of a mixture of two fluids whose manufacturing process is simplified compared to the systems known in the art.

It is another object of the invention to provide a dispensing device for the generation of a mixture of two fluids whose assembly operations are simplified compared to the systems known in the art.

It is a further object of the invention to provide a dispensing device for the generation of a mixture of two fluids whose production costs are lower compared to the systems known in the art.

SUMMARY OF THE PRESENT INVENTION

The present invention is based on the general consideration according to which the problems observed in the state of the art can be at least partially overcome through the manufacture of a device for dispensing mixtures constituted by a first fluid and a second fluid, wherein the device comprises first valve means provided with a first movable element that controls the passage of the first fluid, second valve means provided with a second movable element that controls the passage of the second fluid and third valve means provided with a third movable element that controls the passage of air towards the inside of the container, and wherein at least two among the first, the second and the third movable element belong to a single valve element of the device.

According to a first aspect of the present invention, therefore, the subject of the same is a device for dispensing mixtures constituted by a first fluid and a second fluid, said device being suited to be applied to a container holding said fluids, and comprising:

an outlet duct for said mixture;

at least one chamber suited to receive and/or allow the transit of a given quantity of said first fluid and a given quantity of said second fluid;

means for the generation of said mixture arranged between said chamber and said outlet duct;

first valve means comprising at least one first movable element suited to control the passage of said first fluid from the inside of said container towards said chamber;

second valve means comprising at least one second movable element suited to control the passage of said second fluid from the inside of said container towards said chamber;

third valve means comprising at least one third movable element suited to control the passage of a given quantity of air from the outside of said container towards the inside of said container, wherein at least two among said first movable element, said second movable element and said third movable element belong to a single valve element of said device.

According to a preferred embodiment of the invention, the first movable element and the second movable element belong to a first portion of the valve element and the third movable element belongs to a second portion, distinct from the first portion, of the valve element.

Preferably, the first movable element, the second movable element and the third movable element belong to the same body constituting the valve element.

In a preferred embodiment, the first movable element and the second movable element are constituted by a first flexible edge of the valve element, the first flexible edge being suited to assume a closed position intended to interrupt the passage of the first fluid from the inside of the container towards the chamber and to interrupt the passage of the second fluid from the inside of the container towards the chamber, and being suited to assume an open position intended to allow the passage of the first fluid from the inside of the container towards the chamber and the passage of the second fluid from the inside of the container towards the chamber.

In a further preferred embodiment, said at least one third movable element of said third valve means comprises at least one flexible edge of the valve element, wherein said at least one flexible edge is suited to assume a closed position intended to prevent the passage of the first fluid and/or the passage of the second fluid from the inside of the container and is suited to assume an open position intended to allow the passage of said quantity of air from the outside of the container towards the inside of the container.

Preferably, said at least one third movable element of said third valve means comprises two flexible edges of the valve element suited to be placed in contact with each other in said closed position and to be spaced from each other in said open position.

In a preferred embodiment, the valve element comprises:

a first flexible edge suited to define said first movable element of said first valve means and said second movable element of said second valve means;

two flexible edges suited to define said at least one third movable element of said third valve means.

Preferably, the device according to the invention comprises a first body suited to receive the valve element, wherein the first body and the valve element are suited to define a first conveyance way for conveying the first fluid from the container to the chamber and a second conveyance way for conveying the second fluid from the container to the chamber.

According to a preferred embodiment of the invention, the chamber belongs to a mixer element arranged between the valve element and the outlet duct.

Preferably, the mixer element comprises stop means for the first movable element or the second movable element.

More preferably, the mixer element comprises stop means for the first flexible edge of the valve element.

In a preferred embodiment, the means for generating the mixture comprise a diffuser element and a filtering element.

According to a preferred embodiment of the invention, the diffuser element and the filtering element are housed in a seat created in the mixer element.

Preferably, the mixture is a foam comprising the first fluid and microbubbles of the second fluid. Preferably, the second fluid is air.

Preferably, the container is deformable, more preferably it is manually deformable.

Preferably, the third valve means are suited to refill the container with air.

According to another aspect of the present invention, the subject of the same is a system for dispensing mixtures constituted by a first fluid and a second fluid, comprising a container for said fluids and a device for dispensing said mixtures, said device being applied to said container, wherein the device is made as described above.

BRIEF DESCRIPTION OF THE DRAWINGS

Further advantages, objectives and characteristics of the present invention are defined in the claims and will be clarified below by means of the following description, with reference to the attached drawings. In particular, in the drawings:

DETAILED DESCRIPTION OF THE PRESENT INVENTION

The example of embodiment of the invention described here below refers to devices for dispensing products in the form of foam preferably obtained through the combination of a first fluid, typically in the liquid form, and a second fluid, typically air, both present inside the container to which the device is applied.

It is clear that the proposed solution can be applied also to devices for dispensing foams in which the composition of the two fluids can be different as, for example, in the case of use of a fluid in the form of cream.

Figure 1:
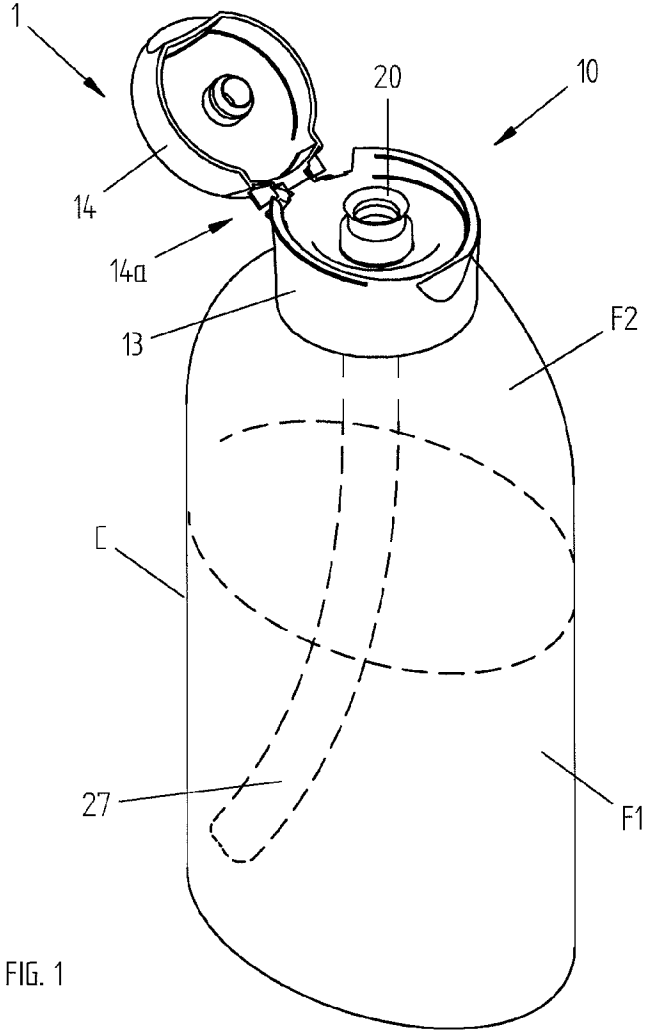
FIG. 1 shows an axonometric view of a device for dispensing fluids associated with a container in such a way as to obtain a dispensing system according to a preferred embodiment of the invention.
Figure 2:
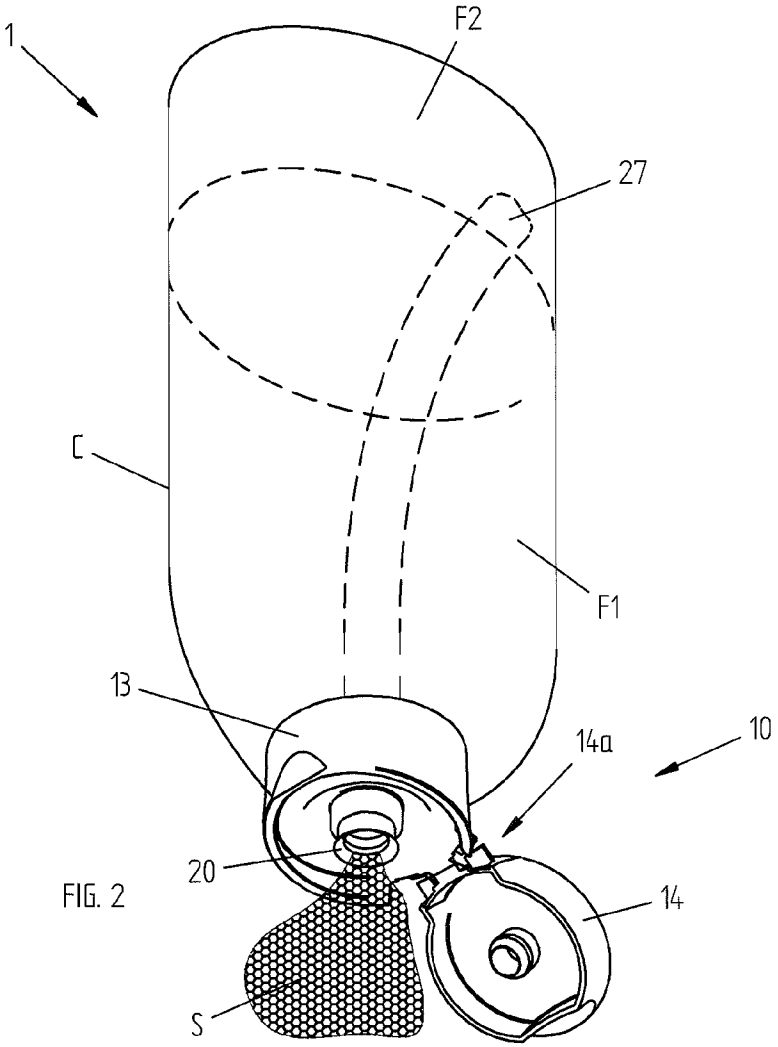
FIG. 2 shows the dispensing system of FIG. 1 positioned upside down, ready for use.
Figure 3:
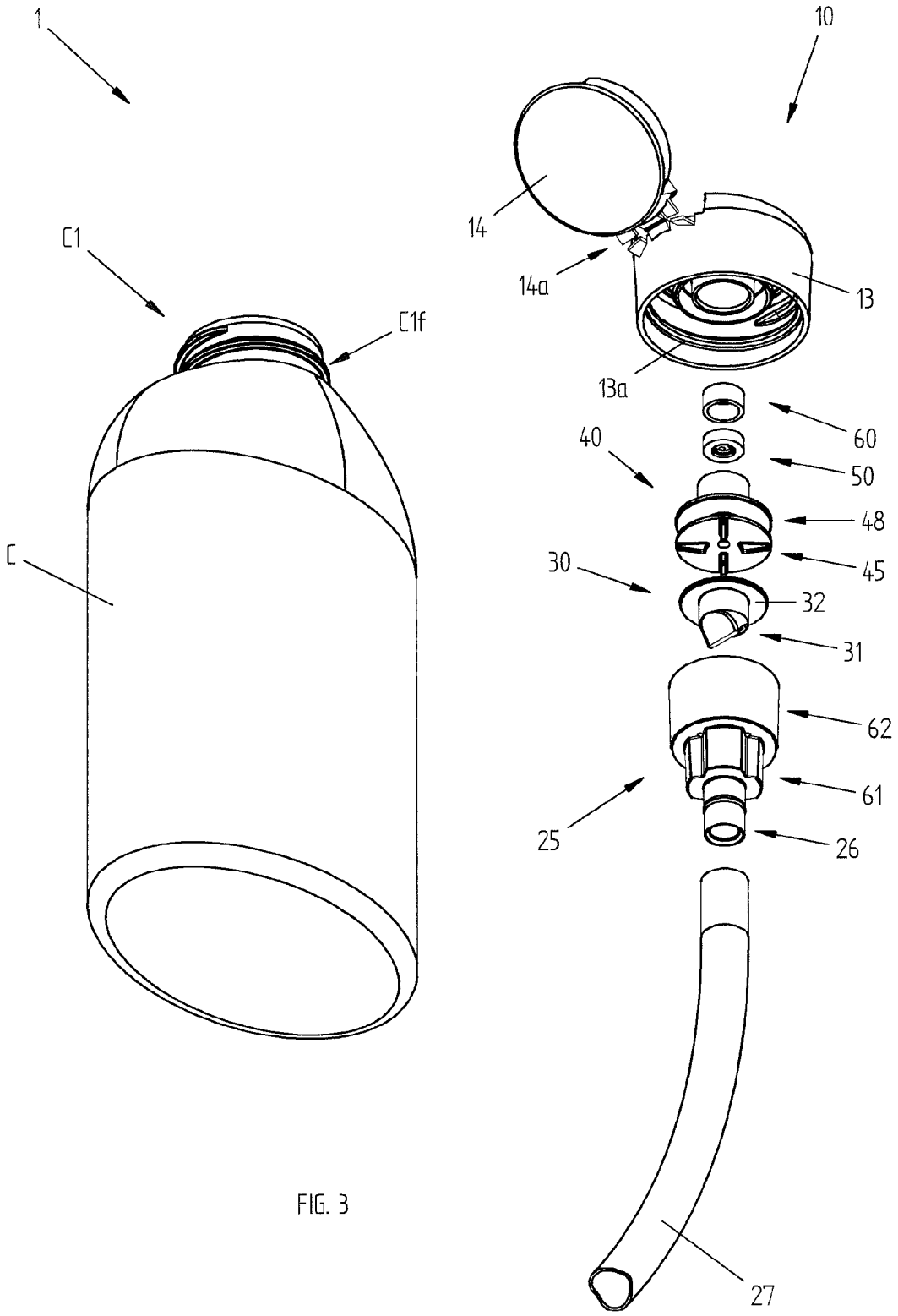
FIG. 3 shows an exploded view of the dispensing system of FIG. 1.
Figure 4A:
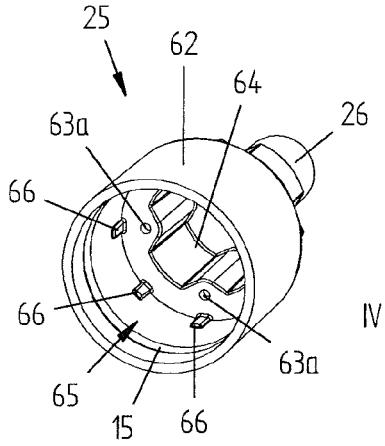
FIG. 4A shows an axonometric view of an element of FIG. 3.
Figure 4B:
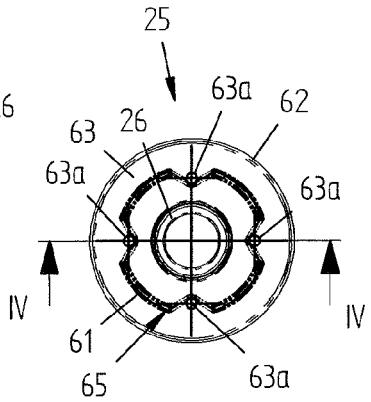
FIG. 4B shows a bottom plan view of the element of FIG. 4A.
Figure 4C:
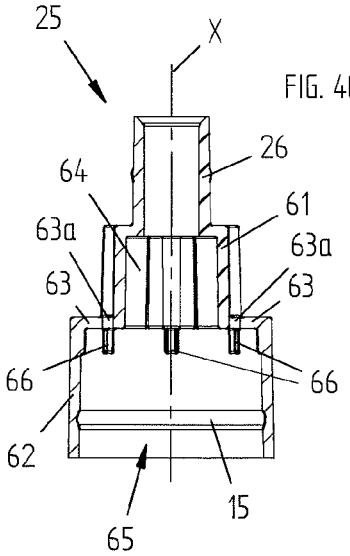
FIG. 4C shows the sectional view along section line IV-IV of FIG. 4B.
Figure 5A:
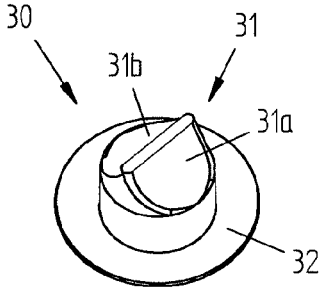
FIG. 5A shows an axonometric view of another element of FIG. 3.
Figure 5B:
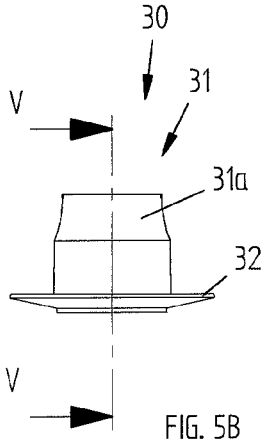
FIG. 5B shows a lateral plan view of the element of FIG. 5A.
Figure 5C:
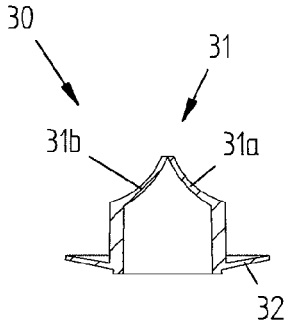
FIG. 5C shows the sectional view along section line V-V of FIG. 5B.
Figure 6A:
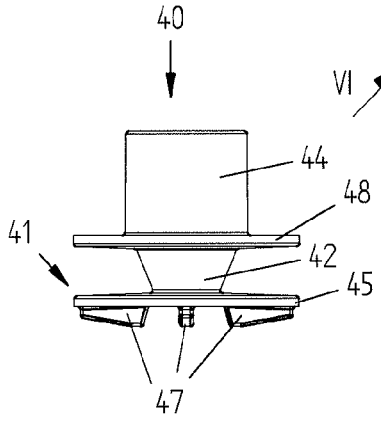
FIG. 6A shows a lateral plan view of another element of FIG. 3.
Figure 6B:
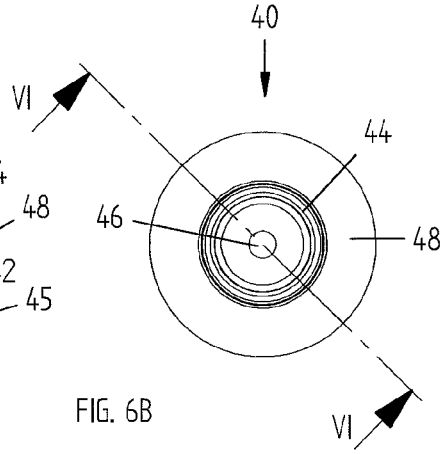
FIG. 6B shows a top plan view of the element of FIG. 6A.
Figure 6C:
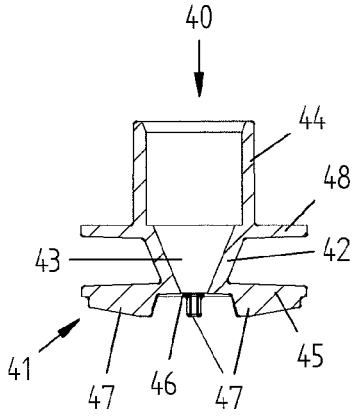
FIG. 6C shows the sectional view along section line VI-VI of FIG. 6B.

An example of embodiment of a system 1 for dispensing a mixture, here below simply referred to as a foam S, is shown in FIGS. 1 and 2, in which a dispensing device which is the subject of the present invention, indicated as a whole by 10, is applied to the neck C1 of the container C holding the fluids F1 and F2 to be mixed. In FIG. 1 the system 1 is shown with the container C and the dispensing device 10 applied to it in the straight position, meaning with the dispensing device 10 positioned on top of the container C. The straight position will correspond to the preferred resting/storage position of the system 1 when it is not in use. As illustrated here below, the operating position for dispensing the foam S, instead, will be the overturned or upside down position shown in FIG. 2, meaning with the container C overturned and the dispensing device 10 arranged under the container C itself.

It should be observed that the container C of the invention is preferably a bottle made of a material that can be easily deformed by the pressure exerted by a hand holding it, and is preferably made of a plastic material.

It is evident that the container can be deformed in any other manner, for example with the aid of mechanisms suited to deform the external surface of the container C.

Said container C, when it is in the straight position, is filled with a first fluid F1 up to a suitable level, shown by the broken line in FIG. 1, while the remaining part above said fluid F1 will contain air, which is suited to be the second fluid F2 making up the foam S to be obtained.

When the system 1 is in the upside down operating position, the first fluid F1 reaches a suitable level, shown by the broken line in FIG. 2, while the remaining part above said fluid F1 will contain the second fluid F2, that is, air.

Further on in the description of the present invention a first operating step (dispensing step) in the use of the dispensing device 10 is illustrated, making reference to the situation in which the system is in the upside down operating position and the container C is squeezed in order to dispense the foam S. A second operating step (air refilling step) in the use of the dispensing device 10 is described, instead, making reference to the situation in which the container C is released and refilled with air, said last step being known as venting.

While for the first operating step the container C must be positioned upside down, the second operating step intended to refill the container with air can take place independently of the position of the container C.

Figure 7B:
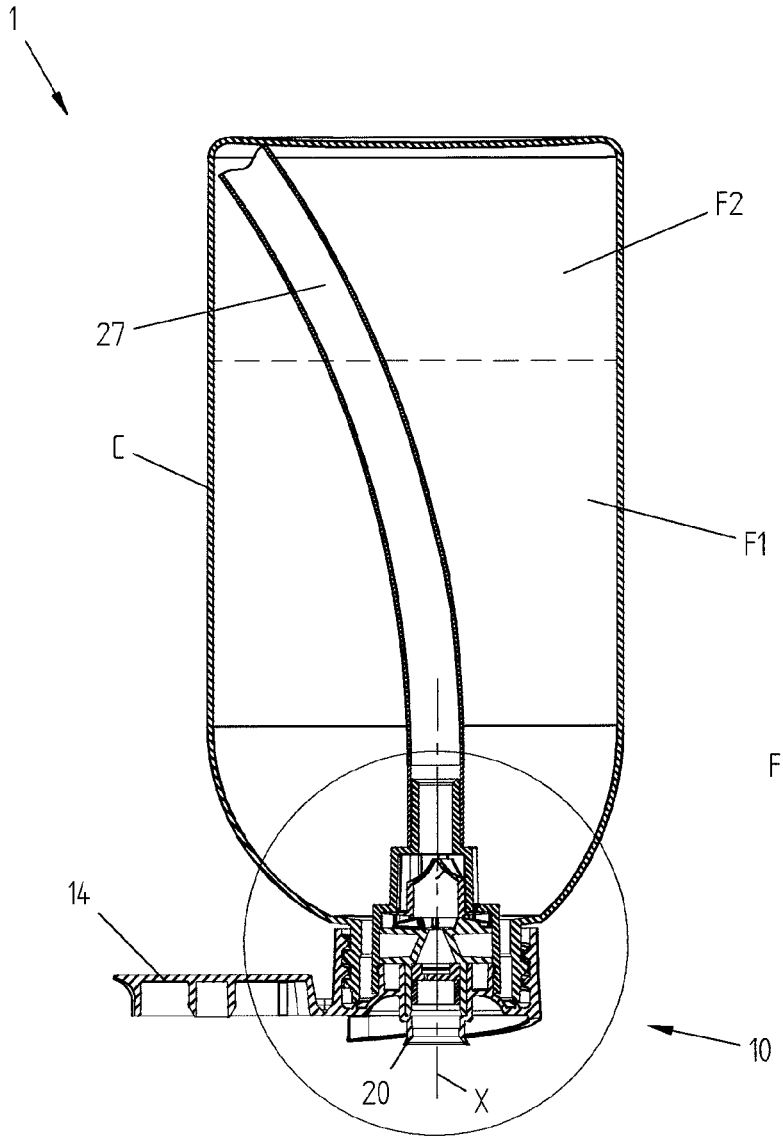
FIG. 7B shows the sectional view along section line VII-VII of FIG. 7A.
Figure 7A:
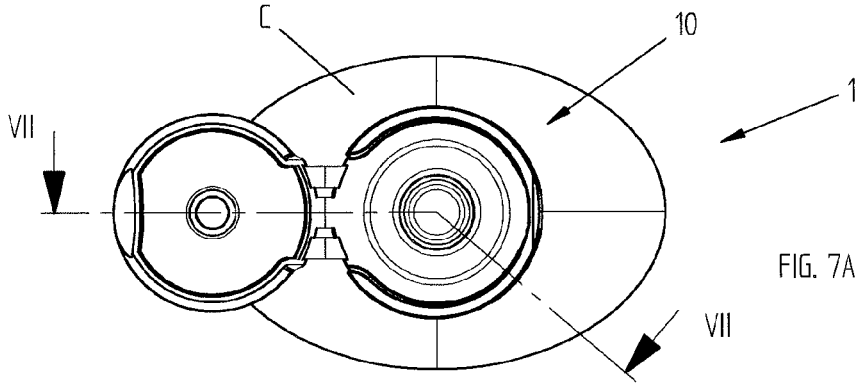
FIG. 7A shows a bottom plan view of the dispensing system of FIG. 2 positioned upside down and in the non-operating condition.
Figure 7C:
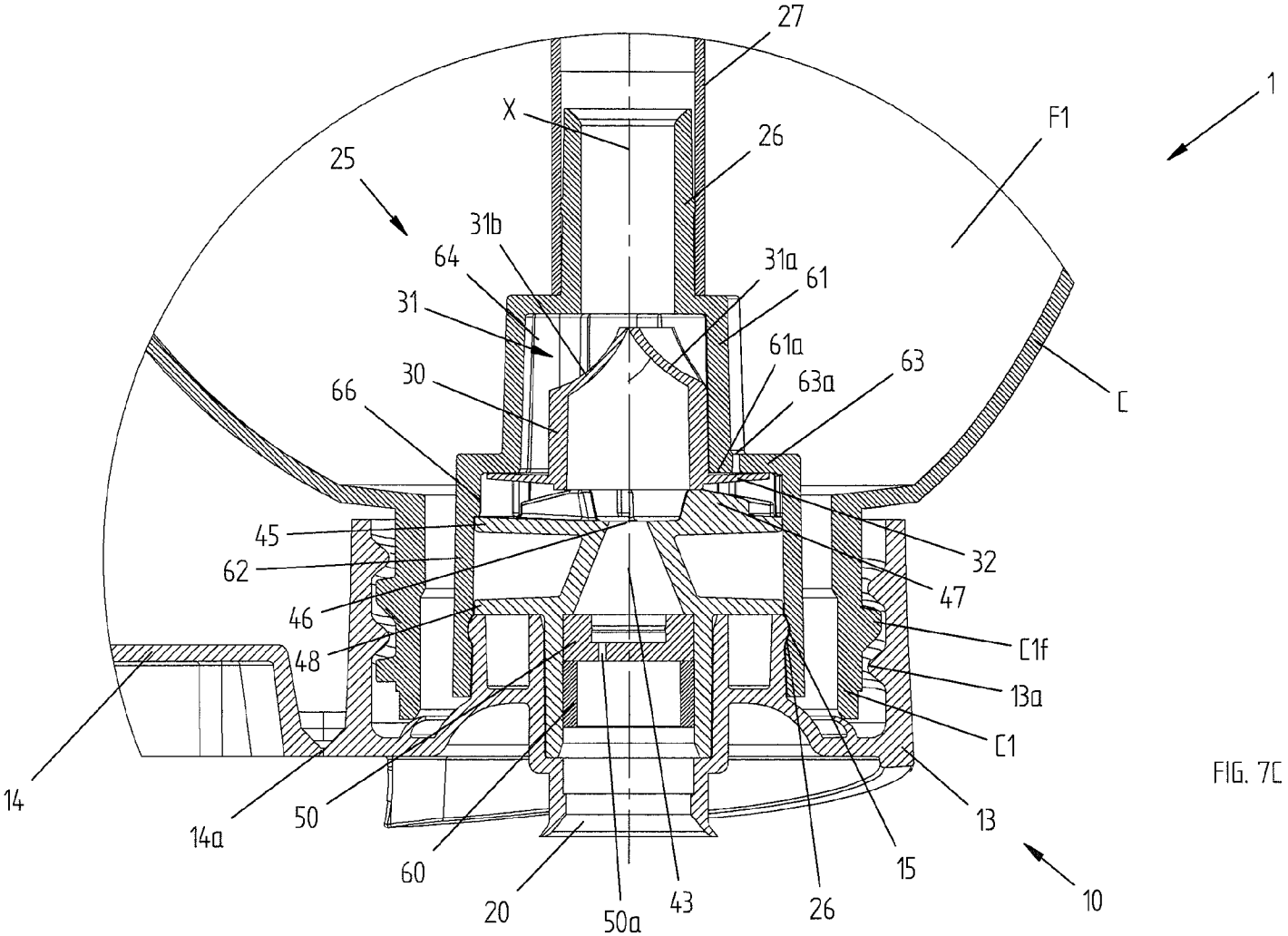
FIG. 7C shows an enlarged detail of FIG. 7B.

The dispensing device 10 that is the subject of the invention comprises a supporting body 13, or supporting structure, provided with coupling means 13*a* with which it can be coupled to the container C, as shown for example in FIG. 7C. Said coupling means 13*a* preferably comprise a threaded portion suited to become engaged with a corresponding threaded portion C1*f* provided on the neck C1 of the container C.

In variant embodiments, said coupling means can be of a different type, for example of the snap-on type.

The supporting body 13 comprises an outlet duct 20 for dispensing the foam S. Preferably, the outlet duct 20 is made in a single piece with said supporting body 13, more preferably in a cylindrical shape and in the centre area of the supporting body 13. It is evident that the shape and the position of the outlet duct can vary depending on the functional and/or aesthetical needs.

The supporting body 13 is preferably associated with a closing element 14 suited to intercept and thus close the outlet duct 20. The supporting body 13 and the closing element 14 are preferably obtained in a single piece, for example through a thermoplastic moulding process.

Advantageously, the closing element 14 can be rotated around a hinge 14*a* with respect to the supporting body 13, so that it can be arranged between an open position, for example that shown in the figures, and a closed position, in which it intercepts the outlet duct 20 (position not shown in the figures).

In variant embodiments the closing element can be made in a different manner and be suitable for its purpose.

The supporting body 13 is associated with a first body 25, better illustrated in FIGS. from 4A to 4C.

The first body 25 is connected to the supporting body 13 and is suited to be inserted in the container C when the dispensing device 10 is screwed onto the container C itself.

Preferably, the first body 25 is connected to the supporting body 13 through a snap-on connection, by means of an annular projection 26 defined on the supporting body 13, which is inserted in a corresponding annular cavity 15 belonging to the first body 25.

In variant embodiments of the invention, the first body 25 and the supporting body 13 can be mutually connected to each other in a different manner, for example through a screwing operation.

The first body 25 comprises a first cylindrical end portion 26 that substantially develops along a main axis X. Said first cylindrical portion 26 houses a thin drawing tube 27 suited to draw the second fluid F2 from a position near the bottom of the container C with the system 1 in the upside down operating position, as can be seen in FIG. 2. Preferably, the thin tube 27 is coupled with the first cylindrical portion 26 through mechanical interference.

The first body 25 houses the other elements of the dispensing device 10, meaning:

a valve element 30;

a mixer element 40;

a diffuser element 50;

a filtering element 60.

It should be noted that the various elements illustrated and described herein, in particular the first body 25, the valve element 30, the mixer element 40, the diffuser element 50 and the filtering element 60 develop, preferably coaxially, around the main axis X and therefore have a preferably partially or completely cylindrical shape. In variant embodiments, however, the various elements can be differently shaped, but obviously conveniently made so that they can be mutually coupled with each other.

The first body 25 has, in addition to the first cylindrical portion 26, a second substantially cylindrical portion 61 and a third cylindrical portion 62.

The second portion 61 has a radial dimension that is smaller than that of the third cylindrical portion 62. The second portion 61 and the third cylindrical portion 62 are joined by a connection surface 63. The connection surface 63 is preferably annular and preferably lies on a plane that is perpendicular to the main axis X. In variant embodiments, the connection surface can be shaped in a different manner.

Said annular cavity 15 is advantageously defined in the third cylindrical portion 62, so that the latter can be coupled with the supporting body 13.

The second portion 61 defines a first chamber 64, in which the valve element 30 is accommodated.

The first cylindrical portion 26 of the first body 25 ends inside said first chamber 64 so as to convey the second fluid F2 during use, as explained below.

The third cylindrical portion 62 defines a second chamber 65, in which the mixer element 40 is accommodated.

Ribs 66 define respective supporting surfaces for the mixer element 40 and define its position inside the second chamber 65, as can be seen for example in FIG. 7C.

The connection surface 63 preferably comprises a plurality of holes 63*a* that end inside said second chamber 65 so as to convey the first fluid F1 during use, as explained below.

The present embodiment is preferably provided with four cylindrical holes 63*a*, equally distributed on the connection surface 63. In variant embodiments, however, a different number of holes can be provided, possibly even one only, in a different position and/or shape.

Figure 9B:
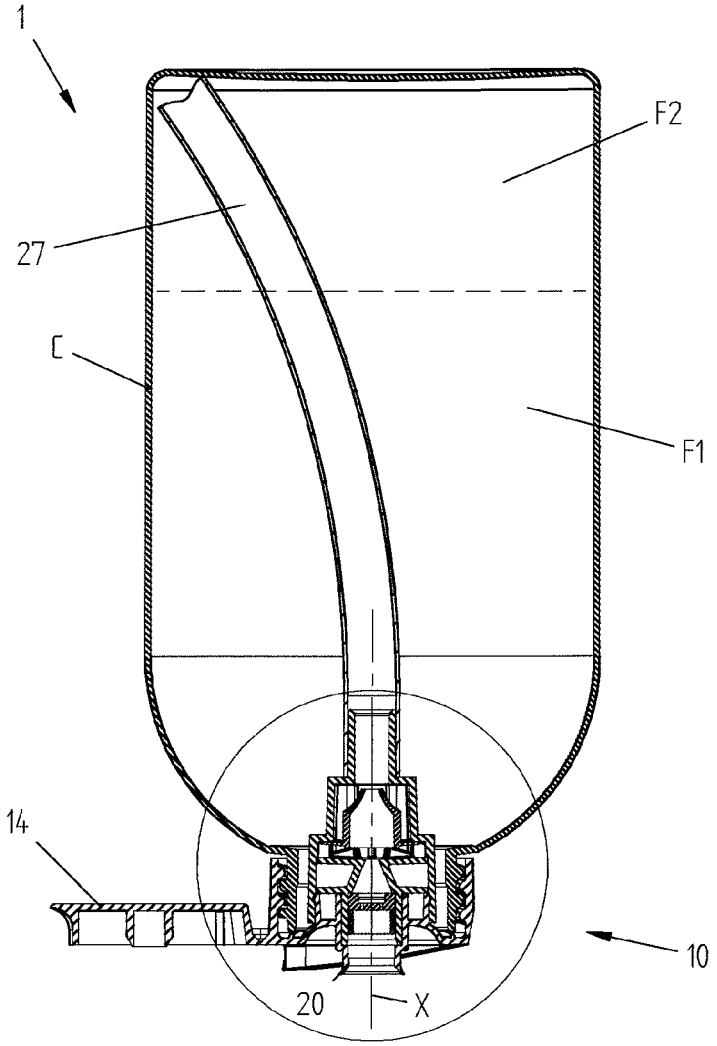
FIG. 9B shows the sectional view along section line IX-IX of FIG. 9A.
Figure 9A:
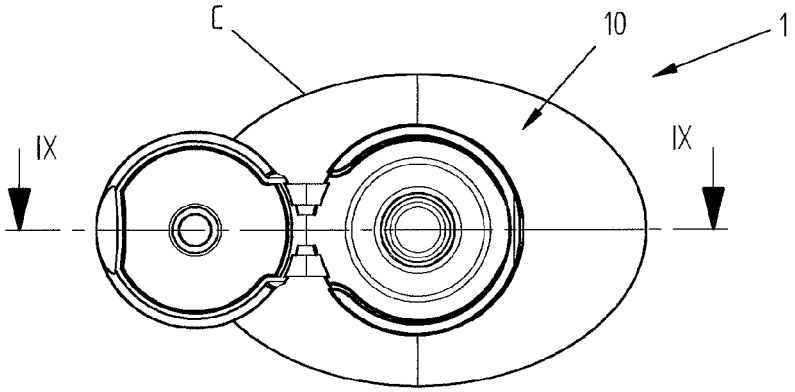
FIG. 9A shows the bottom plan view of the dispensing system of FIG. 3 positioned upside down during the air refilling step.
Figure 9C:
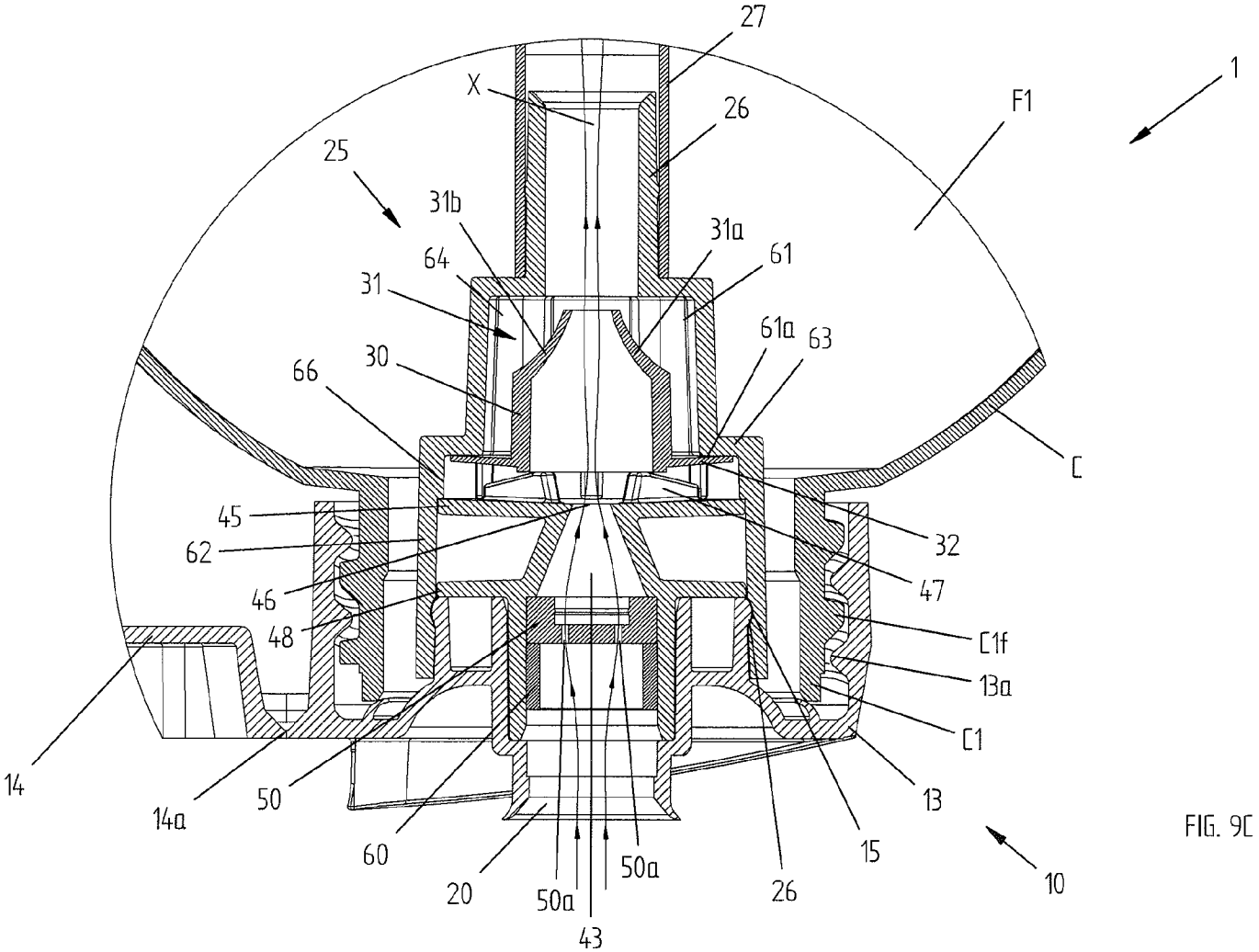
FIG. 9C shows an enlarged detail of FIG. 9B.
Figure 10A:
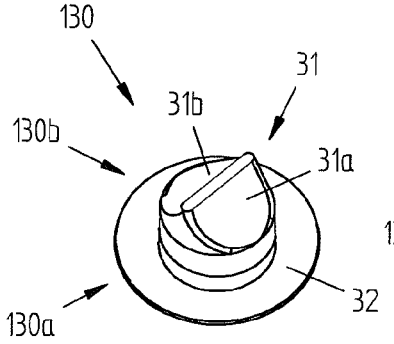
FIG. 10A shows a variant embodiment of the element of FIG. 5A.
Figure 10B:
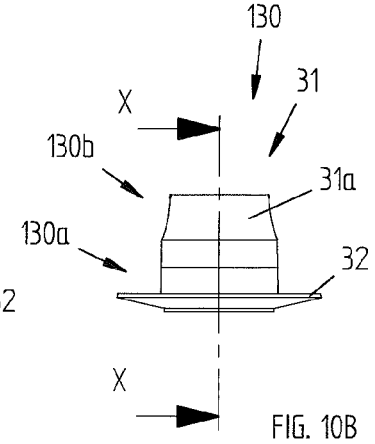
FIG. 10B shows a lateral plan view of the element of FIG. 10A.
Figure 10C:
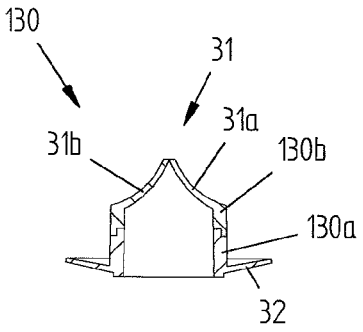
FIG. 10C shows the sectional view along section line X-X of FIG. 10B.

Regarding the valve element 30, better illustrated in FIGS. from 5A to 5C, this preferably comprises a first shaped valve portion 31 comprising two at least partially flexible edges 31*a*, 31*b* normally arranged in contact with each other (closed position), in particular during the dispensing step (first operating step) of the system 1, and in separate positions (open position) during the air refilling step (second operating step) of the system 1, as shown for example in FIG. 9C. The first shaped valve portion 31 actually defines a normally closed valve, as explained in greater detail below.

The valve element 30 comprises also an annular edge 32 that is at least partially flexible.

The annular edge 32 is normally arranged in contact with the annular edge 61*a* of the second portion 61 and at the same time it is arranged in the position in which the holes 63*a* provided in the connection surface 63 are closed, as shown in FIGS. 7C and 9C.

The annular edge 32 assumes this position (closed position) when the system is not being used or even during the air refilling step, as shown for example in FIG. 9C.

The annular edge 32, instead, assumes an open position, that is, not in contact with the annular edge 61*a* of the second portion 61, and at the same time the position in which the holes 63*a* of the connection surface 63 are open. This position is shown, in particular, with reference to FIGS. 8C and 8D and is assumed during the dispensing step.

The annular edge 32 assumes the open position during the dispensing step when the container C is squeezed and, on the one hand, the first fluid F1 flows in through the holes 63*a* of the connection surface 63 of the first body 25 and, on the other hand, the second fluid F2 coming from the thin tube 27 flows through the first chamber 64 of the first body 25 and, coming into contact with the outside of the valve element 30, reaches the annular edge 32. The pushing effect of the two fluids F1, F2 moves and opens the annular edge 32.

The valve element 30 is preferably made of a flexible material, more preferably a silicone-based material.

In the embodiment of the valve element 30 described and illustrated, in particular, in FIGS. from 5A to 5C, the two flexible edges 31*a*, 31*b* of the first shaped valve portion 31 and the annular edge 32 preferably belong to the same body that constitutes the valve element 30 itself.

FIGS. from 10A to 10C show a variant embodiment of the valve element 130 in which, preferably, the annular edge 32 belongs to a first portion 130*a* of the valve element 130 and the two flexible edges 31*a*, 31*b* of the first shaped valve portion 31 belong to a second portion 130*b* of the valve element 130.

The two portions 130*a*, 130*b* are conveniently coupled together, for example through mechanical interference.

Regarding the mixer element 40, better illustrated in FIGS. from 6A to 6C, it preferably comprises a first end portion 41 facing towards the valve element 30, a second portion 42, or mixing portion, inside which a mixing chamber 43 is defined, and a third portion 44 defining a seat suited to accommodate the means for generating the foam S.

The first end portion 41 comprises a circular portion 45, or disc, which comes to be positioned in contact with said ribs 66 of the first body 25 and at a predetermined distance from the valve element 30.

The disc 45 preferably comprises a centre opening 46 that communicates with the mixing chamber 43. In variant embodiments, there may be several holes conveniently distributed on the surface of the disc 45.

Four ribs 47 are preferably defined on the surface of the disc 45 facing towards the valve element 30. Each rib 47 preferably develops according to a trapezoidal pattern.

The ribs 47 actually define a stop element for the maximum opening of the annular edge 32. During the dispensing step, the annular edge 32 thus comes advantageously into contact with said ribs 47.

It is evident that in variant embodiments the number and the shape of said ribs can be different from those illustrated herein.

The mixer element 40 preferably comprises an external circular portion 48, substantially defined between the second portion 42 and the third portion 44, which allows the mixer element 40 to be centred inside the second chamber 65 of the first body 25 and to be held in position when the supporting body 13 is assembled with the first body 25.

The third portion 44 of the mixer element 40 houses the diffuser element 50 and the filtering element 60.

Figure 8B:
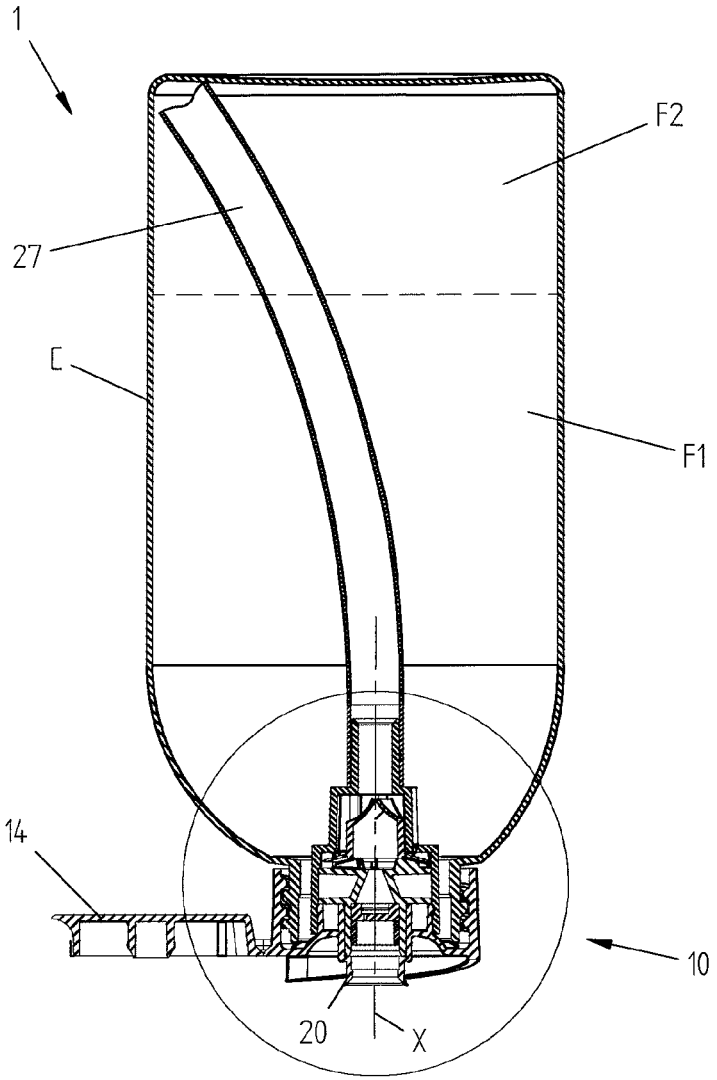
FIG. 8B shows the sectional view along section line VIII-VIII of FIG. 8A.
Figure 8A:
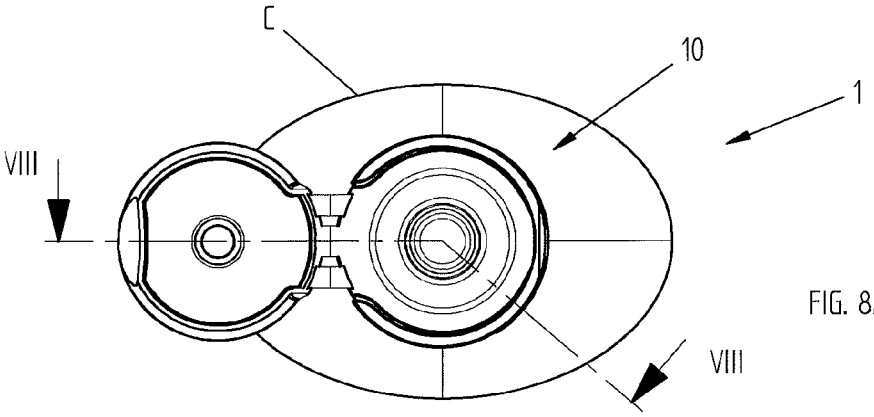
FIG. 8A shows the bottom plan view of the dispensing system of FIG. 3 positioned upside down during the foam dispensing step.
Figures 8C, 8D:
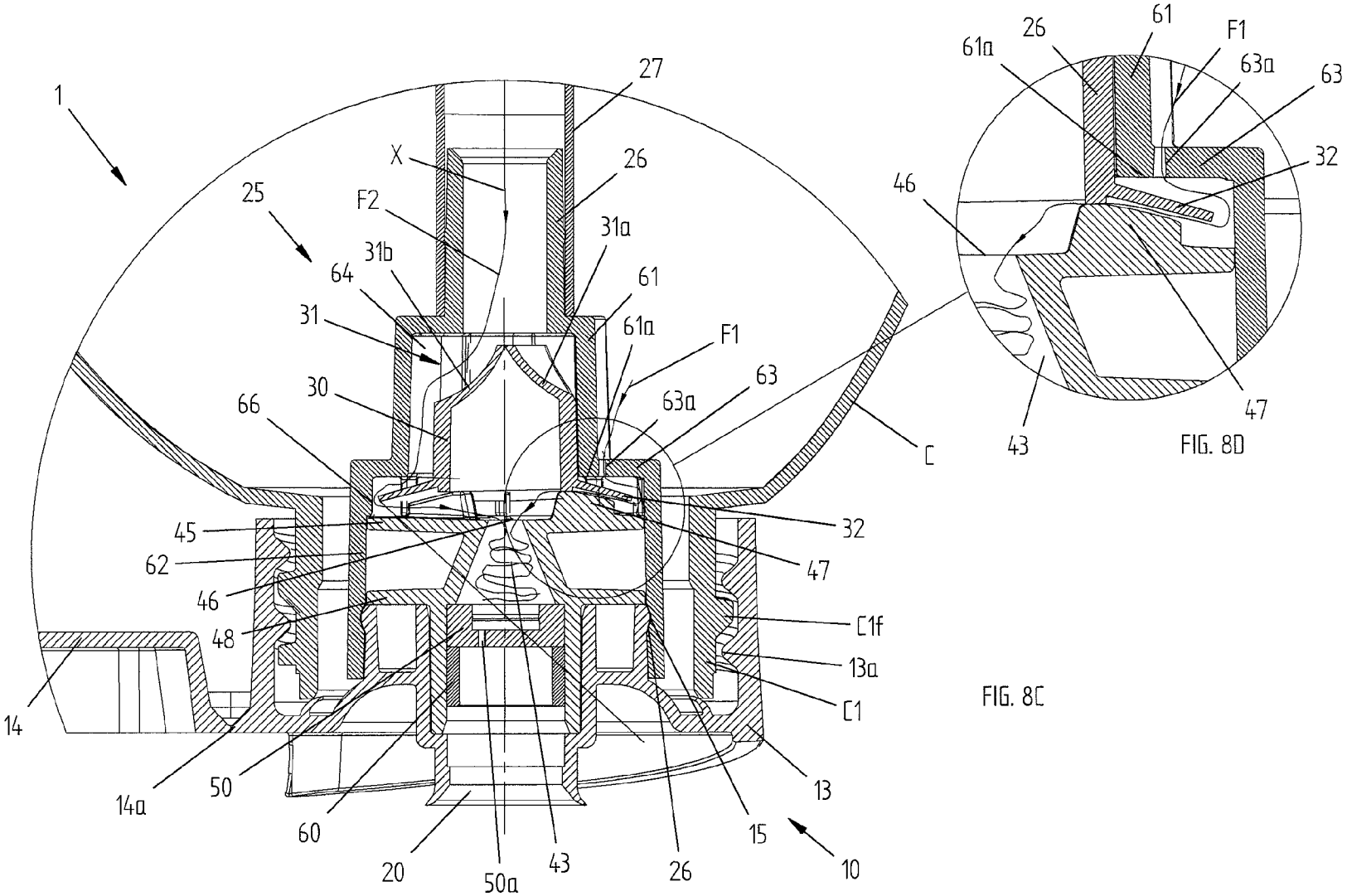
FIG. 8C shows an enlarged detail of FIG. 8B.
FIG. 8D shows an enlarged detail of FIG. 8C.

The diffuser element 50 comprises diffuser holes 50*a*, visible for example in FIGS. 7C and 8C, suited to receive the mixture from the mixing chamber 43 and to convey it towards the filtering element 60.

In the present embodiment there are five holes 50*a*, equally distributed. In variant embodiments, however, the diffuser element may be provided with a different number of holes, possibly even one only, in a convenient shape and position.

The filtering element 60 is advantageously provided with convenient central microholes that, even depending on the viscosity characteristics of the fluid F1, allow the formation of the foam S comprising microscopic air bubbles F2 mixed with the fluid F1.

The operation of the system 1 is described here below, illustrating in particular the first operating step (dispensing step), with reference to FIGS. 8C and 8D, and the second operating step (air refilling step), with reference to FIG. 9C.

To perform the dispensing step, the system 1 is arranged in the upside down position and the container C is squeezed.

The first fluid F1, for example liquid soap, is pressurized and conveyed towards the holes 63*a* of the connection surface 63 and then against the annular edge 32. At the same time, the second fluid F2, for example air, is pressurized and conveyed from the thin tube 27 through the first chamber 64 and outside the valve element 30, against the annular edge 32, too.

The annular edge 32 thus assumes its open position towards and possibly against the ribs 47 and the two fluids F1, F2 are conveyed inside the mixing chamber 43 through the centre opening 46 of the disc 45.

Therefore, preferably, the first body 25 defines, together with the valve element 30, a first conveyance way suited to convey the first fluid F1 from the container C into the mixing chamber 43 and a second conveyance way suited to convey the second fluid F2 from the container C into the mixing chamber 43, wherein, more preferably, the first conveyance way comprises the holes 63*a* of the connection surface 63 and the second conveyance way comprises said first chamber 64.

From the inside of the mixing chamber 43, the mixture of the two fluids F1 and F2 flows through the diffuser element 50 and from the latter through the filtering element 60 so as to form the foam S that is expelled towards the outside from the outlet duct 20.

The container C is released in order to refill it with air, the container C itself is released. On release of the container C, the negative pressure inside the container C causes the annular edge 32 to be moved back and to come into contact with the annular edge 61*a* of the second portion 61 and at the same time to assume the position in which the holes 63*a* of the connection surface 63 are closed, as illustrated in FIG. 9C.

At the same time, the negative pressure inside the container C determines the opening of the edges 31*a*, 31*b* of the first shaped valve portion 31 of the valve element 30.

A given quantity of air is sucked through the opening present between the edges 31*a*, 31*b* in order to restore a quantity of fluids F1 and F2 corresponding to that let out during the previous dispensing step.

The refilling air is sucked, as shown in FIG. 9C, and follows the route from the outlet duct 20 to the filtering element 60, the diffuser element 50, the mixing chamber 43, the centre opening 46 of the disc 45, the opening between the two edges 31*a*, 31*b* and finally the thin tube 27 to reach the inside of the container C.

At the end of the release step, the two edges 31*a*, 31*b* return to their normally closed position and the system 1 is ready for a new dispensing cycle.

Advantageously, in the device 10 carried out according to the invention, the flexible edge 32 of the valve element 30 constitutes the control element for both the passage of the first fluid F1 from the inside of the container C towards the mixing chamber 43 and the passage of the second fluid F2 from the inside of the container C towards the mixing chamber 43. This makes it possible to simplify the manufacturing process of the device compared to the systems provided with distinct valve means for controlling the first fluid F1 and the second fluid F2.

This furthermore simplifies the assembly operations of the device compared to the systems known in the art.

Furthermore, there is a consequent reduction in the production costs of the dispensing device 10 and the system 1, since simpler elements are used and the time required to assemble them is reduced.

Still advantageously, in the device 10 according to the invention also the flexible edges 31*a*, 31*b* that control the flow of the refilling air towards the inside of the container preferably belong to the same valve element 30 on which there is the flexible edge 32 that controls the passage of both fluids F1 and F2 from the container C towards the mixing chamber. This makes it possible to further simplify the manufacturing process compared to the systems provided with distinct valve means for controlling the fluids and the refilling air.

This further simplifies the assembly operations of the device compared to the systems known in the art.

In addition to the above, there is a consequent further reduction of the production costs of the dispensing device 10 and the system 1, since simpler elements are used and the time required to assemble them is reduced.

It has thus been shown, through the present description, that the dispensing device carried out according to the present invention allows the set objects to be achieved. In particular, the dispensing device according to the present invention makes it possible to simplify the manufacturing process and/or the assembly operations compared to the systems known in the art.

Even though the present invention has been illustrated above through the detailed description of two embodiments represented in the drawings, the present invention is not limited to the embodiments described above and illustrated in the drawings; on the contrary, further variants of the embodiments described herein fall within the scope of the present invention, which is defined in the claims.

The invention claimed is:

1. A device for dispensing a mixture constituted by a first fluid and a second fluid, said device being suited to be applied to a container holding said fluids and comprising:

an outlet duct for said mixture;

at least one chamber suited to receive and/or allow the transit of a given quantity of said first fluid and a given quantity of said second fluid;

a generating element housed within a hollow cylindrical body, said generating element for generating said mixture arranged between said chamber and said outlet duct;

a unitary valve concentrically seated within the hollow cylindrical body such that said generating element is positioned between the unitary valve and the outlet duct, said unitary valve: (i) admitting the first and second fluids into chamber in response to pressure applied to the container and (ii) permitting the second fluid into the chamber in response to negative pressure extant within the container and said unitary valve further comprising:

a first valve portion comprising a flexible annular edge selectively sealing one or more holes in the hollow cylindrical body, said first valve portion suited to control the passage of said first fluid from the inside of said container, through said one or more holes, and towards said chamber;

a second valve portion defining an annular chamber between an outer facing of the unitary valve and an inner facing of the hollow cylindrical body, said second valve portion selectively sealed by a portion of the flexible annular edge and suited to control the passage of said second fluid from the inside of said container towards said chamber; and a third valve portion comprising a cooperating flexible sealing edges axially offset from the flexible annular edge, said cooperating flexible sealing edges suited to control the passage of a given quantity of said second fluid from the outside of said container towards the inside of said container.

2. The device according to claim 1, wherein said chamber includes a mixer element positioned between said valve element and said outlet duct.

3. The device according to claim 2, wherein said mixer element comprises a stop element controlling movement of the flexible annular edge.

4. The device according to claim 3, wherein the stop element is constructed and arranged to control passage of the first fluid through the unitary valve.

5. The device according to claim 1, wherein said generating element comprises a diffuser element and a filtering element.

6. The device according to claim 5, wherein said diffuser element and said filtering element are housed in a seat created in said mixer element.

7. The device according to claim 1, wherein said mixture is a foam constituted by said first fluid and micro bubbles of said second fluid.

8. The device according to claim 1, wherein said second fluid is air.

9. The device according to claim 1, wherein said container is deformable.

10. The device according to claim 1, wherein the support body includes a connection surface, said connection surface: (i) including the one or more holes and (ii) constructed and arranged to engage and seal the flexible annular edge when the unitary valve is in a non-operating condition.

11. The device according to claim 1, wherein the unitary valve comprising first and second structural portions coupled together, with the first structural portion including the flexible annular edge and the second structural portion including the cooperating flexible sealing edges.

* * * * *